US007090115B2

(12) United States Patent
Pierce

(10) Patent No.: US 7,090,115 B2
(45) Date of Patent: Aug. 15, 2006

(54) CONTAINER FOR BAGGED BEVERAGES

(76) Inventor: Leon William Pierce, 7382 Caran Ave., Stockton, CA (US) 95207

( * ) Notice: Subject to any disclaimer, the term of this patent is extended or adjusted under 35 U.S.C. 154(b) by 134 days.

(21) Appl. No.: 10/808,624

(22) Filed: Mar. 25, 2004

(65) Prior Publication Data

US 2004/0188504 A1 Sep. 30, 2004

Related U.S. Application Data

(60) Provisional application No. 60/457,682, filed on Mar. 26, 2003.

(51) Int. Cl.
*B65D 5/02* (2006.01)
*B65D 5/60* (2006.01)
*B65D 17/28* (2006.01)

(52) U.S. Cl. ..... 229/109; 229/117.13; 229/117.3; 229/136

(58) Field of Classification Search ..... 229/109, 229/132, 136, 117.13, 117.3, 117.35
See application file for complete search history.

(56) References Cited

U.S. PATENT DOCUMENTS 2,156,999 A * 5/1939 McNeil ..... 229/109
2,351,166 A * 6/1944 Vergobbi ..... 229/132
2,496,043 A * 1/1950 Farrell ..... 229/132
2,670,128 A * 2/1954 Stowitts ..... 229/132
3,147,904 A * 9/1964 Larson ..... 229/217
3,185,377 A * 5/1965 Moore ..... 229/132
4,524,883 A * 6/1985 Herring ..... 229/117.3
4,815,631 A * 3/1989 Eeg et al. ..... 229/117.3
5,234,160 A * 8/1993 Lisiecki ..... 229/136
5,259,550 A * 11/1993 Kuchenbecker ..... 229/109
5,356,022 A * 10/1994 Tipps ..... 229/117.3
6,378,733 B1 * 4/2002 Boonzaier ..... 229/117.13

* cited by examiner

*Primary Examiner*—Gary E. Elkins
(74) *Attorney, Agent, or Firm*—Robert C. Hall

(57) ABSTRACT

A container with first and second opposing, parallel side panels; third and fourth opposing, parallel side panels which define an enclosure; optional first, second, third and fourth corner panels interposed between adjacent ones of the side panels; first and second top flaps respectively associated with the first and second side panels by first and second top creases or fold lines; and third and fourth top flaps respectively associated with the third and fourth side panels by third and fourth top creases or fold lines. The first top crease or fold line is coplanar with a top plane of the container; and the third and fourth top creases are offset below the top plane.

19 Claims, 7 Drawing Sheets

CONTAINER FOR BAGGED BEVERAGES

CROSS REFERENCE TO RELATED APPLICATIONS

This patent application is entitled under 35 USC §119(e) to the benefit of U.S. Provisional Patent Application No. 60/457,682, filed on Mar. 26, 2003, the disclosure of which is incorporated herein by reference in its entirety.

BACKGROUND OF THE INVENTION

Beverages such as wines, fruit juices, dairy beverages, malt beverages and the like have traditionally been stored and transported in various types of bottles or cans. The opening of bottled or canned beverages exposes the contents to air, and the contained beverage usually must be consumed relatively quickly to prevent spoilage. In particular bottled wine, once opened, will typically undergo oxidation that can result in unwanted change in taste, aroma, color, or other properties.

Wine has a long tradition of being stored in corked glass bottles. This storage technique was many years ago the best available for preserving wine. A much more effective way of storing wine has more recently been offered by collapsible containers or bags, with a valve or spigot in the bag providing for egress of the beverage and preventing introduction of air to the beverage remaining in the container. As beverage is removed from the bag via the spigot, the bag collapses. Wine consumers, due to the aforementioned tradition, have resisted wine containers other than corked glass bottles. The advantages inherent in collapsible bag containers, however, have overcome consumer prejudice and the market for bagged wines is rapidly increasing.

Bagged beverages are typically stored in a box or like container, as the bags themselves are not conveniently handled. Containers for bagged liquids must be sufficiently robust to support the relatively large weight of the contained liquid during transportation and storage. Conventional box designs often do not lend themselves to use with bagged beverages, as the boxes are prone to collapse when subject to relatively small force. Further, the flap closure arrangement of conventional box containers usually presents sharp flap edges on both the inside and outside surfaces of the container. The inside flap edges create a risk of rupture to the bag within the container, and the outside edges create a risk of injury to persons handling the containers. Still further, the flap closure arrangements of conventional boxes allow insects to penetrate into the container. The present invention overcomes these deficiencies.

SUMMARY OF THE INVENTION

This invention provides a box or container that is inexpensive, robust, and usable in the transportation, storage and dispensing of bagged beverages or other liquids held within the container. The container comprises, in general terms: first and second opposing, parallel side panels; third and fourth opposing, parallel side panels which may be perpendicular to the first and second panels; optional first, second, third and fourth corner panels interposed between adjacent ones of the side panels to form an octagonal enclosure; first and second top flaps respectively associated with the first and second side panels by first and second top creases or fold lines; and third and fourth top flaps respectively associated with the third and fourth side panels by third and fourth top creases or fold lines. The first top crease or fold line is coplanar with a top plane of the container; and the second, third and fourth top creases are offset with respect to the top plane.

The container may additionally comprise first and second bottom flaps respectively associated with the first and second side panels by first and second bottom creases or fold lines, and third and fourth bottom flaps respectively associated with the third and fourth side panels by third and fourth creases or fold lines. The first bottom crease is coplanar with a bottom plane of the container, and the second, third and fourth bottom creases are offset with respect to the bottom plane.

In certain embodiments, the second top crease is offset from the top plane by a first offset distance, and the third and fourth top creases or fold lines are offset from the top plane by a second offset distance smaller than the first offset distance. In such embodiments the first top flap is foldable to a position coplanar with the top plane, the third and fourth top flaps are foldable to positions beneath the top plane, and the second top flap is foldable to a position beneath the folded third and fourth top flaps. One or both of the first and second top flaps may be configured to conform to the shape of the container enclosure, and include side edges and/or corner edges that engage or contact adjacent ones of the side and/or corner panels when the flaps are in a closed position.

Similarly, the second bottom crease may be offset from the bottom plane by a first offset distance and the third and fourth bottom creases are offset from the bottom plane by a second, smaller offset distance, such that the first bottom flap is foldable to a position coplanar with the bottom plane, the third and fourth bottom flaps are foldable to positions above the bottom plane, and the second bottom flap is foldable to a position above the folded third and fourth bottom flaps. One or both of the first and second bottom flaps may be configured to conform to the shape of the container enclosure, and include side edges and/or corner edges that engage or contact adjacent ones of the side and/or corner panels when the flaps are in a closed position.

In embodiments where corner panels are included, first, second third and fourth corner panels may each have first, second, third and fourth top ends respectively, with the first, second, third and fourth top ends extending above the second, third and fourth top creases to the top plane. Similarly, the first, second third and fourth corner panels may each have first, second, third and fourth bottom ends respectively that extend below the second, third and fourth bottom creases to the bottom plane.

DETAILED DESCRIPTION OF THE INVENTION

Figure 1:
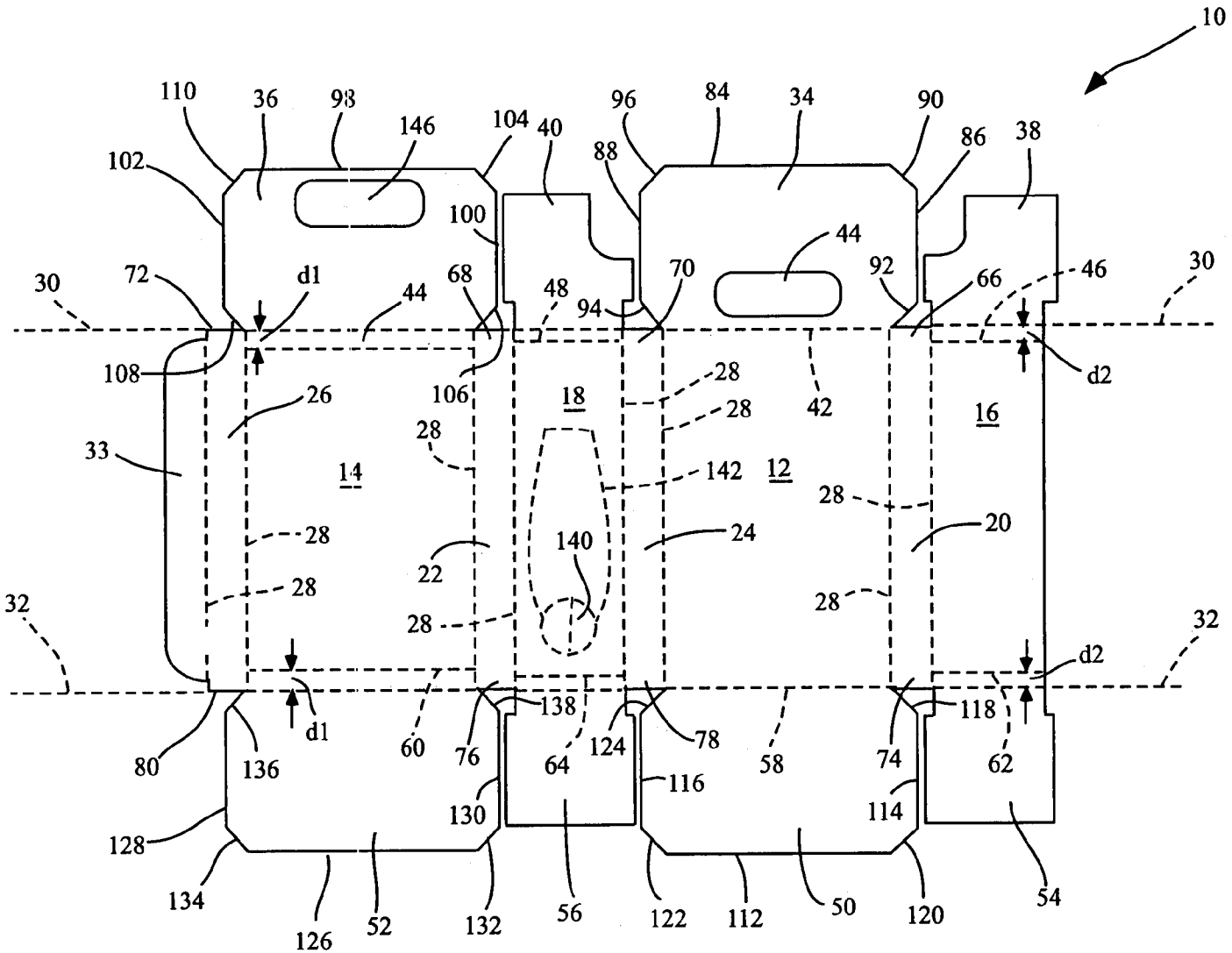
FIG. 1 is a plan view of a container in accordance with the invention shown as a flat, unassembled "blank".
Figure 2:
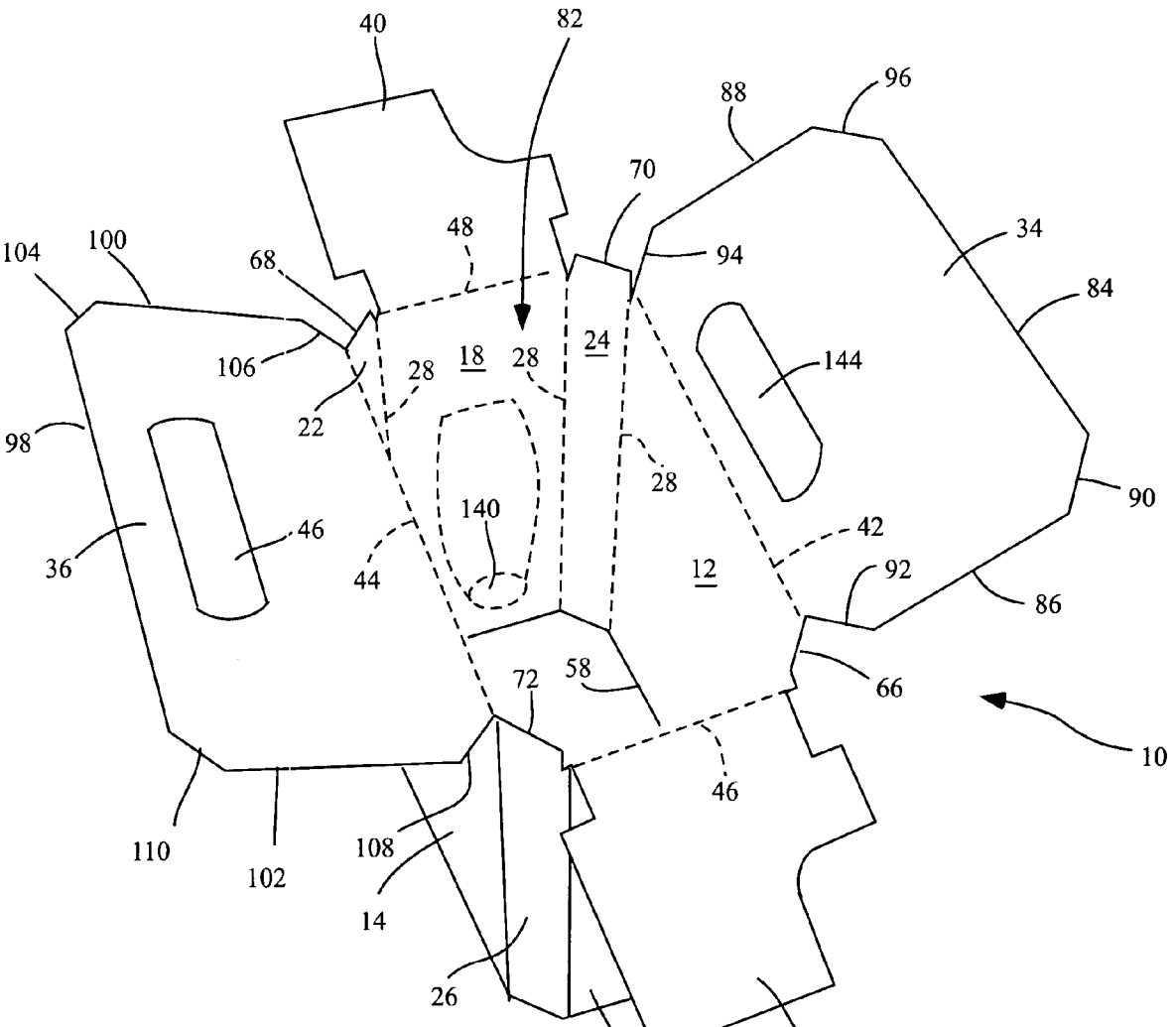
FIG. 2 is a top perspective view of a container in accordance with the invention with all top flaps shown in an open position.
Figure 3:
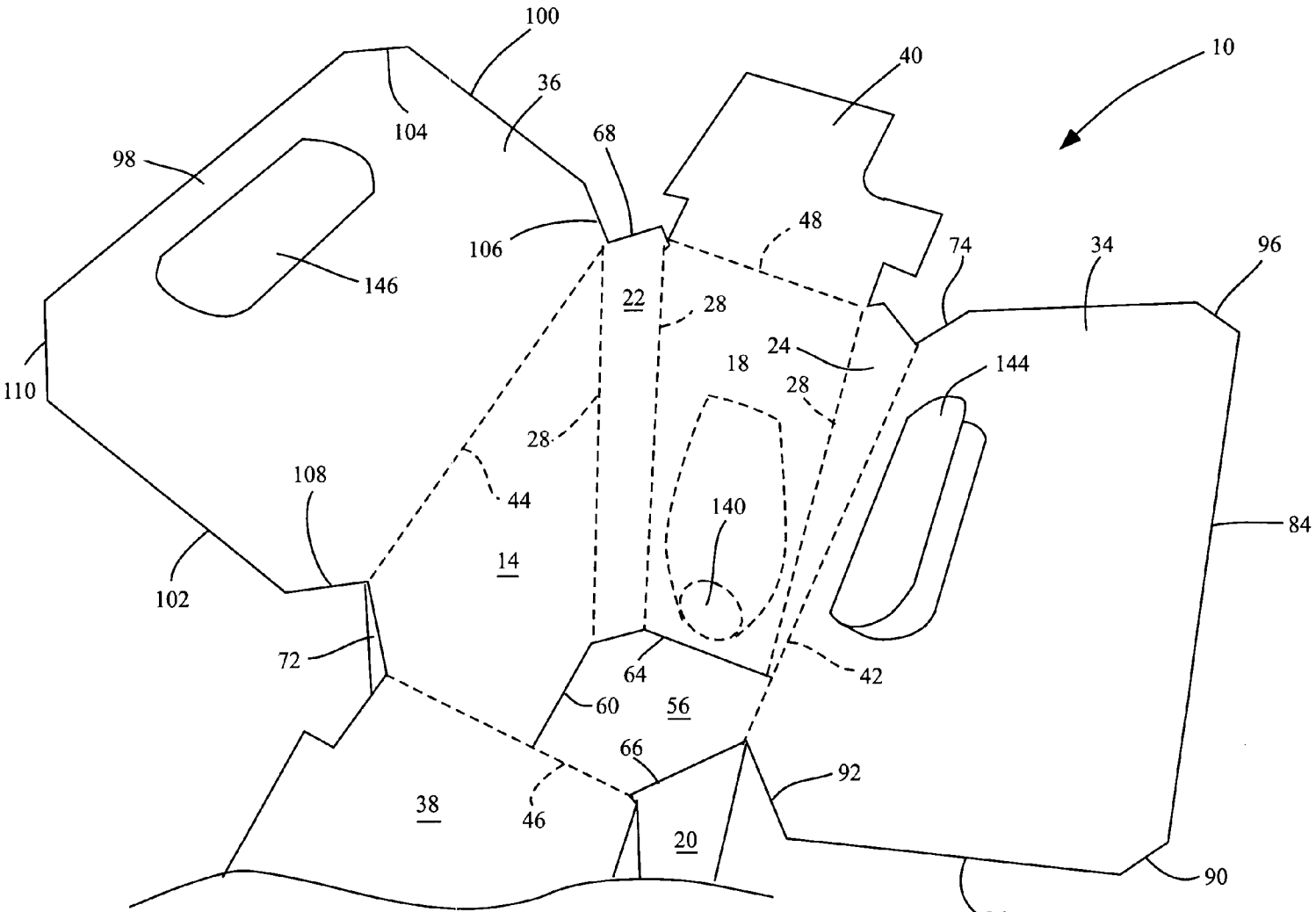
FIG. 3 is another top perspective view of the container of the invention with the top flaps shown in the open position.
Figure 4:
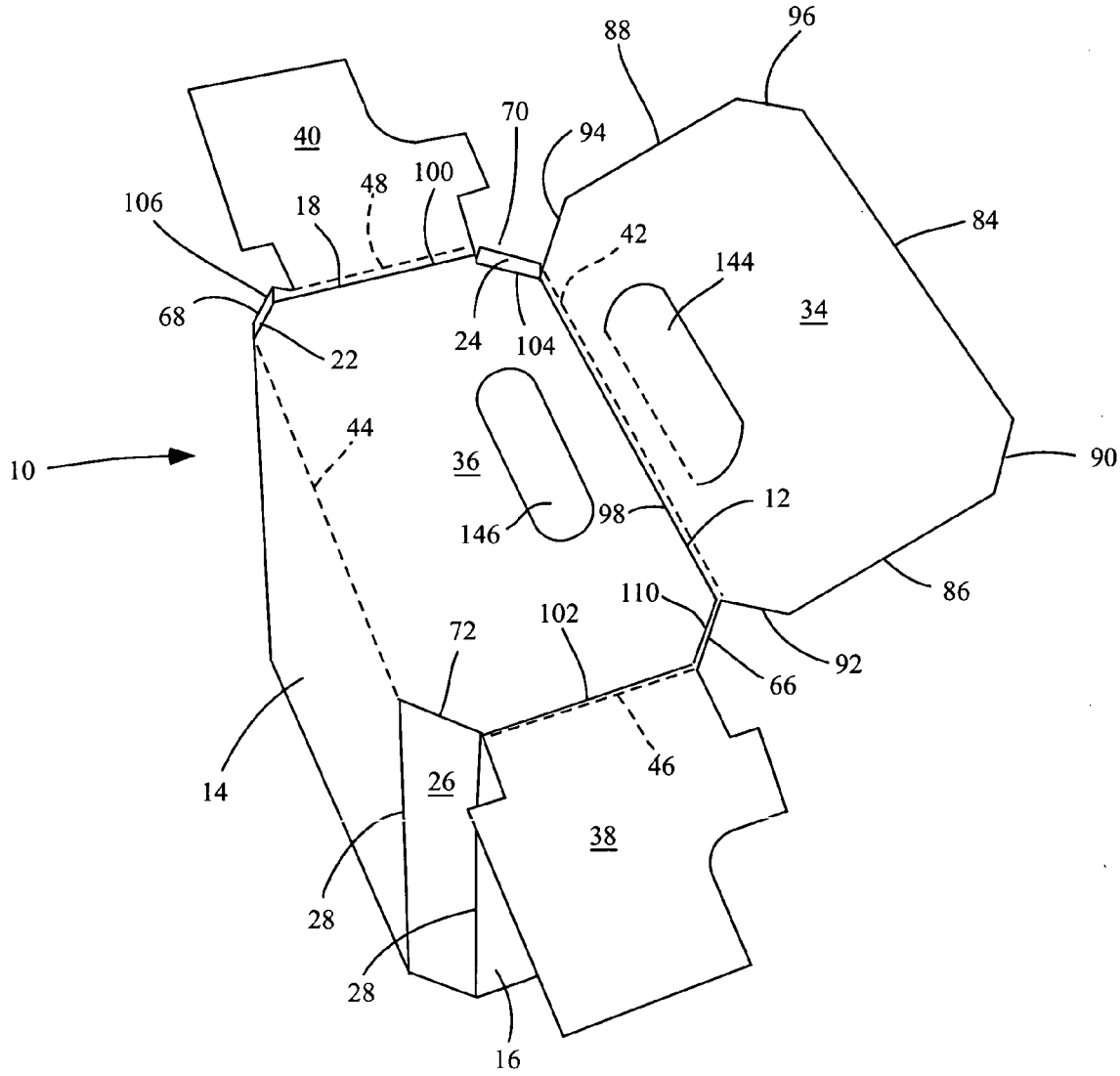
FIG. 4 is top perspective view of the container of the invention with the second top flap shown folded to a closed position and with the first, third and fourth flaps shown in the open position.
Figure 5:
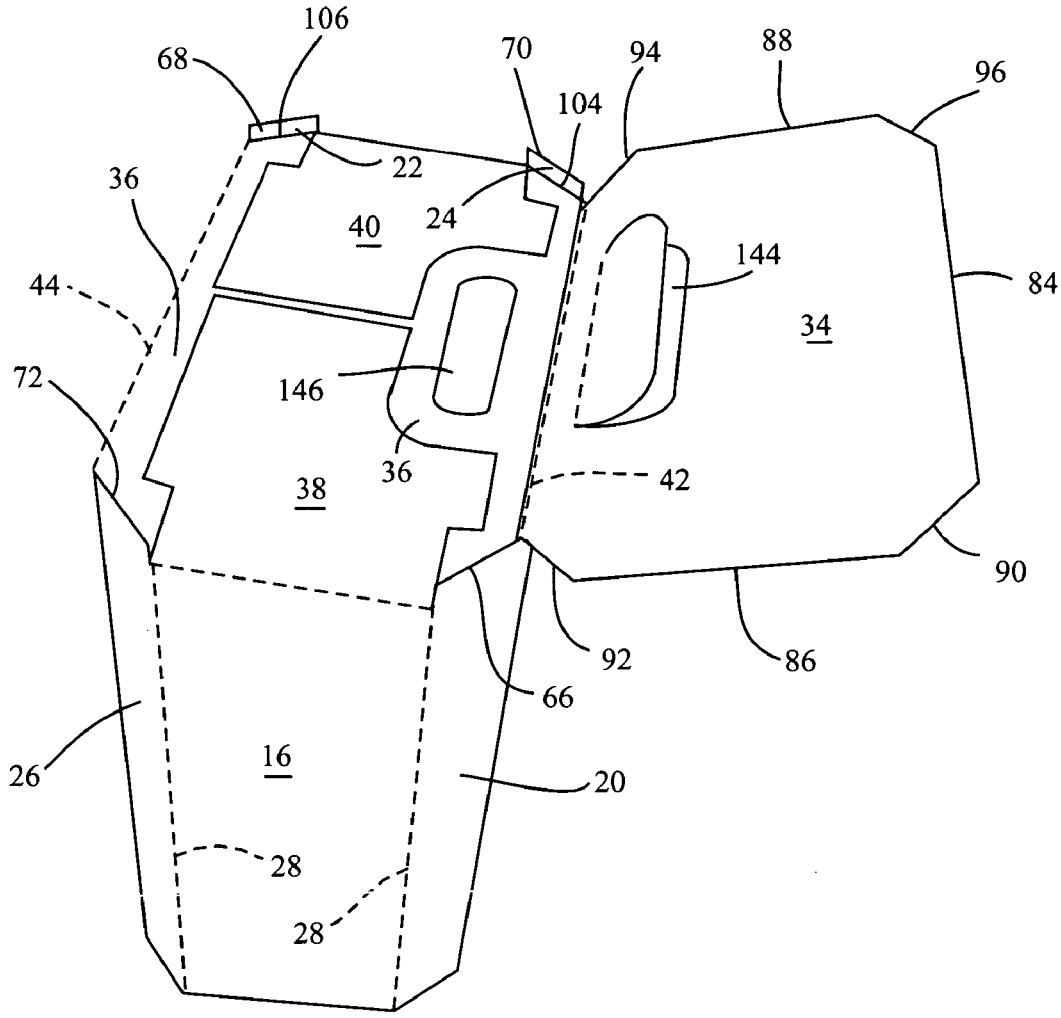
FIG. 5 is a top perspective view of the container of the invention with the second, third and fourth top flaps shown in the closed position and with the first top flaps in the open position.
Figure 6:
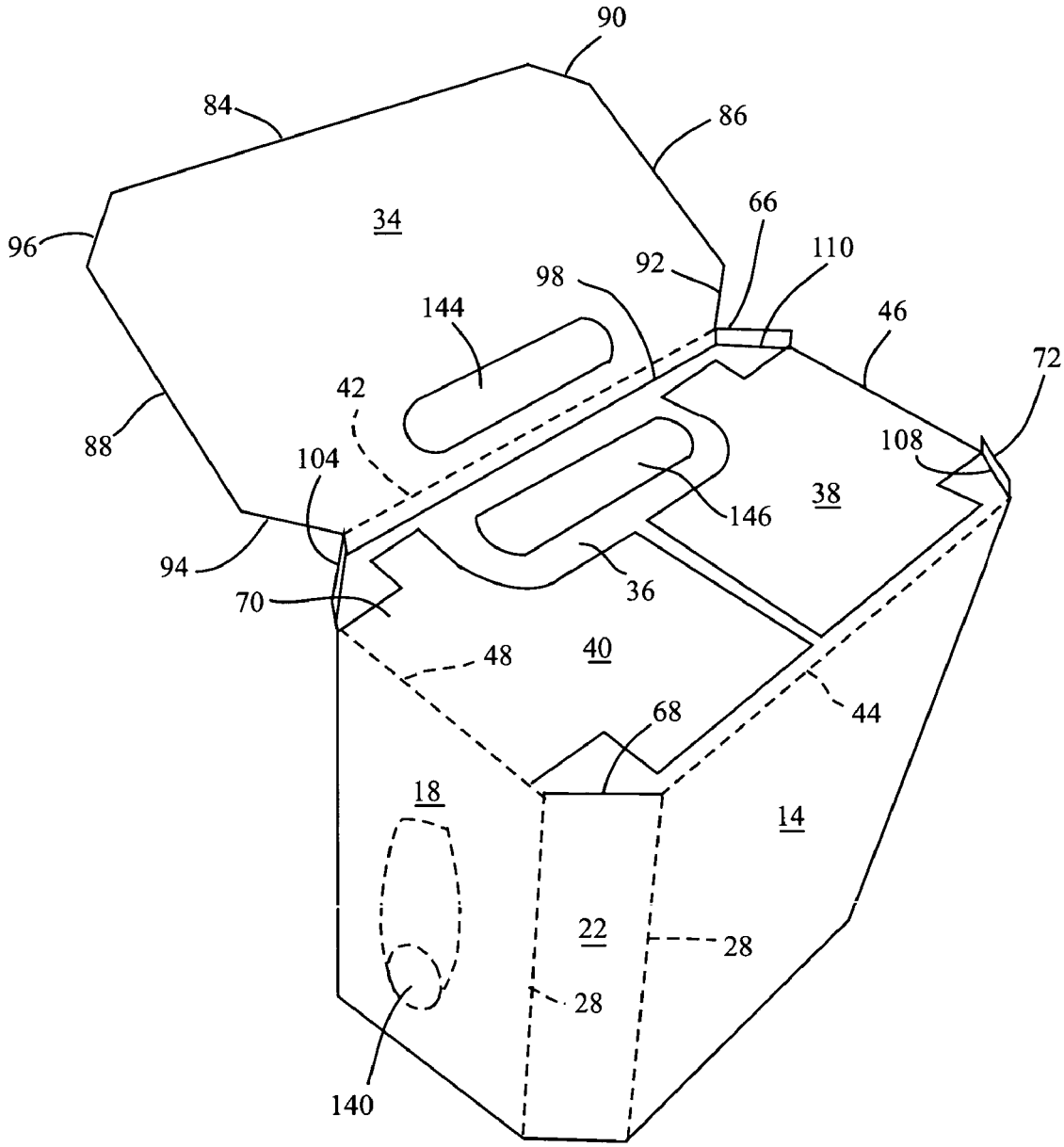
FIG. 6 is another top perspective view of the container of the invention with the second, third and fourth top flaps shown in the closed position and with the first top flap in the open position.
Figure 7:
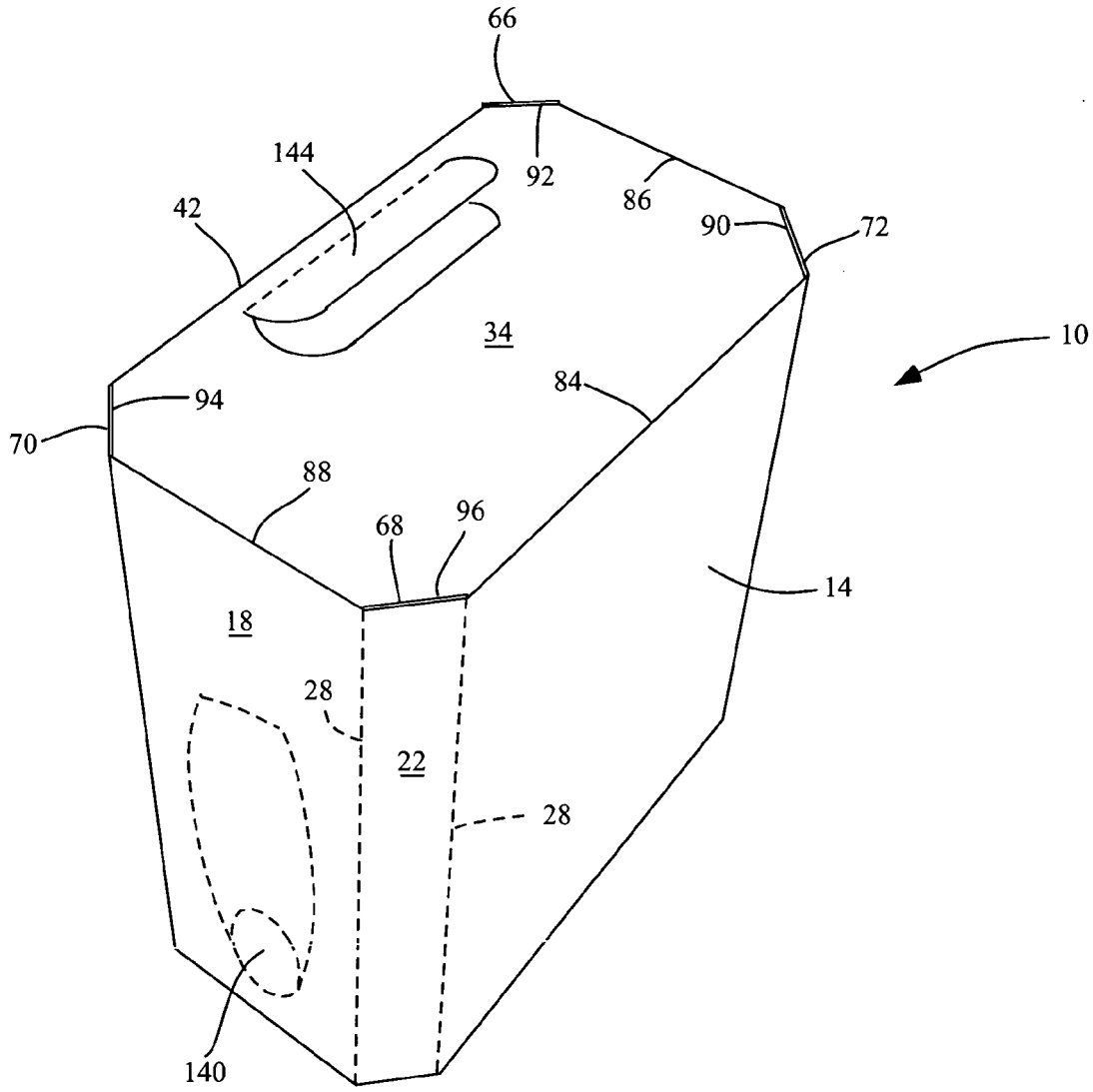
FIG. 7 is a top perspective view of the container of the invention with all top flaps shown in the closed position.

Referring more specifically to the drawings, for illustrative purposes the present invention is embodied in the container apparatus shown FIG. 1 through FIG. 7. It will be appreciated that the apparatus may vary as to configuration and as to details of the parts without departing from the basic concepts as disclosed herein. Various parts and components in the drawings may be shown as exaggerated in size for reason of clarity, and the dimensions shown in the drawings should not be considered limiting. The container of the invention, while disclosed generally in terms of use with bagged beverages or other liquids, has many other uses. The container may be made of any suitable material using any fabrication technique. In many embodiments the container may constructed from corrugated paperboard or "card board" or plastic or foamed plastic sheet material that can be formed by conventional cutting and folding.

Referring now to FIG. 1, there is shown a container apparatus 10 in accordance with the invention, in a collapsed or unassembled configuration. The container 10 as shown in FIG. 1 represents a template or "blank" that would be cut from sheet material such as corrugated paperboard, and creased or folded to permit assembly. Container 10 includes first, second, third and fourth side panels 12, 14, 16, 18 respectively, and first, second, third and fourth corner panels 20, 22, 24, 26 respectively. Each corner panel 20, 22, 24, 26 is interposed between adjacent ones of the side panels 12, 14, 16, 18, so that the assembled box has an eight-sided or octagonal shape as described below. The side panels 12, 14, 16, 18 and corner panels 20, 22, 24, 26 are separated and defined from each other by longitudinal creases or fold lines 28 that are substantially perpendicular to a top plane 30 and a bottom plane 32 of the container 10. Top and bottom planes 30, 32 represent the top and bottom surfaces of the assembled container 10, and are shown as dashed lines in FIG. 1. A glue flap 33 is joined to corner panel 26 and is configured to adhere or bond to side panel 16, so that the container 10 forms an octagonal-shaped enclosure as described further below. First and second side panels 12, 14 are shown as major side panels having a larger surface area than third and fourth panels 16, 18, which are shown as minor side panels. The third and fourth panels 16, 18 are in turn shown as being larger in area than corner panels 20, 22, 24, 26. These dimensions are only illustrative of one embodiment and may vary as required for different embodiments of the invention.

Container 10 includes top flaps 34, 36, 38, 40 that are joined to and associated with side panels 12, 14, 16, 18 by top fold lines or creases 42, 44, 46, 48 respectively. Thus, a first top flap 34 is joined to first side panel 12 at a first top crease 42, while second top flap 36 is joined to second side panel 14 via a second top crease 44, third top flap 38 is joined to third side panel 16 via third top crease 46, and fourth top flap 40 is joined to fourth side panel 18 by fourth top crease 48. Top creases 42, 44, 46, 48 are substantially perpendicular to longitudinal creases 28. First and second top flaps 34, 36 are major top flaps and are shown as greater in surface area than third and fourth top flaps 38, 40, which serve as minor top flaps.

Also included on container 10 are bottom flaps 50, 52, 54, 56 that are joined to and associated with side panels 12, 14, 16, 18 by bottom fold lines or creases 58, 60, 62, 64 respectively. The first bottom flap 50 is joined to first side panel 12 along a first bottom crease 58, and a second bottom flap 52 is joined to second side panel 14 along a second bottom crease 60. Similarly, a third bottom flap 54 is joined to third side panel 16 via third bottom crease 62, and fourth bottom flap 56 is joined to fourth side panel 18 by fourth bottom crease 64. Bottom creases are substantially perpendicular to longitudinal creases 28. First and second bottom flaps 50, 52 are major bottom flaps and are greater in surface area than third and fourth bottom flaps 54, 56 that serve as minor bottom flaps.

First top crease 42 is substantially coplanar with the top plane 30 of container 10. Second, third and fourth top creases 44, 46, 48 are offset or recessed with respect to top plane 30, such that second, third and fourth top creases 44, 46, 48 are not coplanar with top plane 30. In the embodiment of FIG. 1, second top crease 44 is offset from the top plane 30 (and first top crease 42) by a first offset amount or distance d1, while third and fourth top creases 46, 48 are offset from top plane 30 and first top crease 42 by a second amount or distance d2 that is smaller than offset distance d1. In other embodiments, offset distances d1 and d2 may be equal to each other, or offset d2 may be greater than offset distance d1.

In a similar manner, first bottom crease 58 is substantially coplanar with the bottom plane 32 of container 10, while second, third and fourth bottom creases 60, 62, 64 are offset or displaced with respect to bottom plane 32, such that second, third and fourth bottom creases 60, 62, 64 are not coplanar with bottom plane 32. Second bottom crease 60 is shown as being offset from the bottom plane 32 and first bottom crease 58 by a first offset amount or distance d1, while third and fourth bottom creases 62, 64 are offset from bottom plane 32 and first bottom crease 58 by a second amount or distance d2 that is shown smaller than offset distance d1. The relative magnitude of offset distances d1 and d2 may be varied as noted above. The offset distances associated bottom creases may be the same as or different from the offset distances used for the top creases.

Referring to FIG. 2 through FIG. 7 as well as FIG. 1, the offsets of second, third and fourth top creases or fold lines 44, 46, 48 with respect to the top plane 30 of container 10 results in the top ends 66, 68, 70, 72 of corner panels 20, 22, 24, 26 extending above fold lines 44, 46, 48. Top ends 66, 68, 70, 72 of corner panels 20, 22, 24, 26 thus extend above second, third and fourth top flaps 36, 38, 40 when top flaps 36, 38, 40 are folded approximately ninety degrees from the positions shown in FIG. 1. When first top flap 34 is folded approximately ninety degrees from the positions shown in FIG. 1, first top flap 34 is substantially flush or level with top plane 30 and corner panel top ends 66, 68, 70, 72, while the folded second, third and fourth top flaps 36, 38, 40 lie beneath the folded first top flap and are recessed with respect to top plane 30 and the corner panel top ends 66, 68, 70, 72.

The offsets of the top creases are such that second top flap 36 serves as an inner top flap and first top flap 34 serves as an outer top flap. The second top crease 44 is offset from top plane 30 by a smaller amount d1 than the offset d2 of third and fourth top creases 46, 48, such that the folded second top flap 36 is positioned beneath the folded third and fourth top flaps 38, 40, which in turn are positioned beneath the first top flap 34.

The folding of bottom flaps 50, 52, 54, 56 operates in the same manner as described and shown for top flaps 34, 36, 38, 40. The offsets of second, third and fourth bottom creases 60, 62, 64 with respect to bottom plane 32 of container 10 results in the bottom ends 74, 76, 78, 80 of corner panels 20, 22, 24, 26 extending below bottom creases 60, 62, 64, such that corner panel bottom ends 74, 76, 78, 80 extend below second, third and fourth bottom flaps 52, 54, 56 when the bottom flaps are folded approximately ninety degrees from the positions shown in FIG. 1. First bottom flap 50, when folded, is substantially flush or level with bottom plane 32 and corner panel bottom ends 74, 76, 78, 80, and the folded second, third and fourth bottom flaps 52, 54, 56 are positioned above the folded first bottom flap and are above or recessed with respect to bottom plane 32 and the corner panel bottom 74, 76, 78, 80.

The differing offset amounts d1 and d2 result in the folded second bottom flap 52 being positioned above the folded first bottom flap 50, while the folded third and fourth bottom flaps 54, 56 are positioned between the first bottom flap 50 and second bottom flap 52.

When glue flap 33 is adhered to the surface of side panel 16, an octagonal, tubular enclosure 82 (FIG. 2) is formed or defined by side panels 12, 14, 16, 18 and corner panels 20, 22, 24, 26 of container 10. The first and second top flaps 36, 38 are structured and configured to conform to the shape or outline of enclosure 82 when first and second top flaps 36, 38 are folded inward along first and second top creases 42, 44. When first and second top flaps 34, 36 are folded to the closed position, the side edges and corner edges of the folded top flaps 34, 36 support the side panels and corner panels of container 10 and reinforce the container 10. In this regard, first top flap 34 includes side edges 84, 86, 88 which are structured and configured to position themselves adjacent to side panels 14, 16, 18 respectively when first top flap 34 is folded to the closed position. First top flap also includes corner edges 90, 92, 94, 96 structured and configured to position themselves adjacent corner panels 26, 20, 24, 22 of container 10 when first top flap 34 is folded to the closed position, i.e., approximately ninety degrees from the position shown in FIG. 1. Thus, when first top flap 34 is folded, side edge 84 is adjacent side panel 14, side edges 86, 88 are adjacent side panels 16, 18 respectively, and corner edges 90, 92, 94, 96 respectively are adjacent corner panels 26, 20, 24, 22. Since corner panel top ends 66, 68, 70, 72 extend upward to top plane 30, corner edges 90, 92, 94, 96 can contact and engage corner panels 26, 20, 24, 22 when the top flap 34 is in the closed position.

Second top flap 36 similarly includes side edges 98, 100, 102 and corner edges 104, 106, 108, 110. When second top flap 36 is folded inward to the closed position, side edges 98, 100, 102 of second top flap 36 are respectively adjacent to side panels 12, 18 and 16, with corner edges 104, 106, 108, 110 being respectively adjacent to corner panels 24, 22, 26, 20. Since second top flap is recessed below top plane 30, side edges 98, 100, 102 contact and engage side panels 12, 18 and 16, and corner edges 104, 106, 108, 110 contact and engage corner panels 24, 22, 26, 20, when second top flap 36 is in the closed position.

First and second bottom flaps 50, 52 are likewise structured and configured to conform to the shape or outline of enclosure 82 and reinforce container 10 when folded inward along first and second bottom creases 58, 60. First bottom flap 50 includes side edges 112, 114, 116 and corner edges 118, 120, 122, 124 which position themselves adjacent to corresponding ones of side panels 12, 14, 16, 18 and corner panels 20, 22, 24, 26 of container 10 when first bottom flap 50 is folded to the closed position. Second bottom flap 52 includes side edges 126, 128, 130 and corner edges 132, 134, 136, 138 that contact and engage adjacent ones of side panels 12, 14, 16, 18 and corner panels 20, 22, 24, 26 of container 10 when second bottom flap 52 is folded to the closed position.

In the assembly of the container 10, glue flap 33 is adhered to the surface of side panel 16 to form octagonal, tubular enclosure 82, with side panels 12, 14, 16, 18 and corner panels 20, 22, 24, 26 folded about longitudinal creases 28. The second bottom flap 52 is folded inward along bottom crease 60 and positioned such that corner edges 132, 134, 136 138 are aligned and in contact with adjacent ones of corner panels 20, 22, 24, 26, and side edges 126, 128, 130 are aligned and in contact with adjacent side panels 12, 14, 16. Once thus aligned, the third and fourth bottom flaps 54, 56 are folded inward along bottom creases 64, 66 respectively, and the outer surface of the second bottom flap 52 is adhered to the inner surfaces of the third and fourth bottom flaps 54, 56. The first bottom flap 50 is then folded inward along bottom crease 58 and positioned such that that corner edges 120, 122, 124, 126 are aligned with and in contact with adjacent ones of corner panels 20, 22, 24, 26, and side edges 112, 114, 116 are aligned with and in contact with adjacent ones of side panels 12, 14, 16. The inner surface of the first bottom flap 50 is then adhered to the outer surfaces of the third and fourth bottom flaps 54, 56. Many adhesives suitable for use with corrugated paperboard or plastic sheet may be used to assemble the container 10 in this manner. With bottom flaps 50, 52, 54, 56 thus assembled, the first, outermost bottom flap 50 is generally coplanar with container bottom plane 32 and flush with corner panel bottom ends 74, 76, 78, 80, while the second, third and fourth bottom flaps 52, 54, 56 are positioned within container 10 above the outermost first flap 50.

A beverage bag (not shown) may be inserted in the container 10 once the bottom flaps are assembled in the above manner. In this regard, a spigot pop-out 140 may be defined by perforation line 142 to accommodate a pour spigot (not shown) on the beverage bag. When the beverage bag is suitably positioned within enclosure 82, second top flap 36 is folded inward along top crease 44 and positioned such that side edges 98, 100, 102 are in contact with side panels 12, 18 and 16 respectively, and corner edges 102, 104, 106, 108 are in contact with corner panels 24, 22, 26, 20 respectively. Third and fourth top flaps 38, 40 are then folded inward along top creases 46, 48 respectively, and the outer surface of second top flap 36 is adhered to the inner surface of third and fourth top flaps 38, 40. First top flap 34 is then folded inward along top crease 42 and positioned such that side edges 84, 86, 88 are adjacent to side panels 14, 16, 18 respectively, and corner edges 90, 92, 94, 96 are respectively are adjacent corner panels 26, 20, 24, 22. The inner surface of the thusly-positioned first top flap 34 is then adhered to the outer surfaces of third and fourth top flaps 38, 40. Perforations may be provided in first and second top flaps 34, 36 to define handle cutouts or pop-outs 144, 146, to facilitate handling of the assembled container 10 by a user.

Many different embodiments of the invention other than those described herein are possible and will suggest themselves to those skilled in the art upon review of this disclosure, and such embodiments are also considered to be within the scope of the invention. In one such embodiment, third and fourth top fold lines 46, 48 and third and fourth bottom fold lines 62, 64, instead of being offset, may be coplanar with top plane 30 and bottom plane 32 respectively. In another embodiment, the offset distance d2 may be greater than the offset distance d1, such that the third and fourth top flaps and bottom flaps 34, 36, 50, 52 are the innermost flaps of the container 10. The offset distances of the various flap fold lines may all be different from each other. The relative size of offsets d1 and d2 as shown in the drawings is exaggerated for clarity. In many embodiments the offset distance d1 will be equal to the combined thickness of second, third and fourth top flaps 36, 38, 40 (and second, third and fourth bottom flaps 52, 54, 56), while offset distance d1 may correspond to the thickness of third and fourth top flaps 38, 40 (and third and fourth bottom flaps 54, 56).

The container 10 of the invention provides several advantages over conventional containers. In the assembled container 10, the side edges and corner edges of the first and second top flaps 34, 36 and first and second bottom flaps 50, 52 engage and provide support to the adjacent side panels 12, 14, 16, 18 and corner panels 20, 22, 24, 26 of container 10. The first and second top flaps 34, 36 and first and second bottom flaps 50, 52 provide support to and reinforce the container 10 and result in a robustness suitable to support heavy loads, such as bagged liquids, within the container 10. Multiple containers 10 can be stacked higher, and be subject to greater stress, than conventional boxes or containers, without danger of collapse.

The container 10 of the invention is also advantageous in that the inner top and bottom surfaces of the container are each defined by a single flap (i.e., second top and bottom flaps 36, 52) that conforms to the shape of the container, and thus no exposed flap edges are present on the inner surfaces of container 10. Conventional boxes typically have edges on the inner top and bottom of the container that are presented by the innermost flaps. The die-cut edges of corrugated paperboard are notoriously sharp and present a potential risk to rupture of bagged liquids within the containers. This risk is aggravated during shipboard or truck or lorry transportation, as the engine vibration and periodic or harmonic motion resulting from a ship screw or road surface can create a "sawing" action of internal flap edges against the bagged liquid within the container. The rupture of the bagged liquid contents of a single container will result in the stored liquid cascading down onto stacked containers beneath the rupture. The escaped liquid from a single collapsed container weakens the underlying containers, which in turn are subject to collapse and additional rupture of bagged liquid contents, and can result in a catastrophic destruction of an entire load of stacked containers. The absence of such exposed internal flap edges in the container 10 avoids this problem.

Conventional containers also typically have sharp, die-cut flap edges on the outer top and bottom surfaces. These edges present a risk of injury to persons handling the containers. The container 10 of the invention avoids this hazard by providing outermost top and bottom flaps that conform to the shape of the container, such that the side and corner edges of the outermost flaps are adjacent to and contact the container side panels. The edges of the outer top and bottom flaps thus are not exposed during handling in a manner that creates a risk of injury.

Another advantage offered by the invention is that container 10 is relatively impervious to penetration by insects. Bagged fruit juices and wines include sugars that are inherently attractive to insects such as ants, cockroaches, earwigs and the like. Even with careful preparation, some residual juice or wine is often present on an exterior bag surface and likely to attract insects. The flap closure mechanism of conventional containers typically leaves openings or interstices dimensioned to allow penetration by insects, the presence of which detract from the marketability of the contained juice or wine. The presence of inserts such as the glassy-winged sharpshooter additionally present an agricultural hazard, and the presence of such pests in containers results in more stringent shipping controls and increased transportation costs.

The container 10 of the invention includes outermost top and bottom flaps that conform to the shape of the container, with the side and corner edges of the outermost flaps adjacent to and contacting the container side panels and corner panes as noted above. The closure arrangement of the container 10 thus presents no openings or interstices through which insects can gain access to the container. It is noted in this regard that handle cutouts 144, 146 and a spigot pop out 140 may be included on container 10 and defined by perforations as described above. These perforations are left intact during transportation and storage, and are left intact and are not broken or opened to form the handles or spigot opening until the container 10 and its contents have reached its final destination.

Accordingly, it will be seen that the invention provides a robust container suitable for use with heavy contents such as bagged liquids. While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective spirit and scope of the present invention. All such modifications are intended to be within the scope of the claims appended hereto.

What is claimed is:

1. A container, comprising:

(a) first and second opposing side panels;

(b) third and fourth opposing side panels;

(c) first, second, third and fourth corner panels, each said corner panel interposed between adjacent ones of said first, second, third and fourth side panels, said side panels and said corner panels forming an octagonal enclosure;

(d) first and second top flaps respectively associated with said first and second side panels by first and second top fold lines, said first top fold line coplanar with a top plane of said container;

(e) third and fourth top flaps respectively associated with said third and fourth side panels by third and fourth top fold lines, said second, third and fourth top fold lines offset from said top plane;

(f) first and second bottom flaps respectively associated with said first and second side panels by first and second bottom fold lines, said first bottom fold line coplanar with a bottom plane of said container; and (g) third and fourth bottom flaps respectively associated with said third and fourth side panels by third and fourth fold lines, said second, third and fourth bottom fold lines offset from said bottom plane;

(h) said first, second, third and fourth corner panels each having a top end extending to said first top fold line and said top plane;

(i) said first, second, third and fourth corner panels each having a bottom end extending to said first bottom fold line and said bottom plane.

2. The container of claim 1 wherein:

(a) said first top flap is flush with said first, second, third and fourth corner panel top ends when said first top flap is folded to a closed position; and (b) said first bottom flap is flush with said first, second, third and fourth corner panel bottom ends when said first bottom flap is folded to a closed position.

3. The container of claim 2 wherein:

(a) said first and second top flaps are configured to conform in shape to said octagonal enclosure, said second top flap including first, second and third edges configured to contact and engage adjacent ones of said side panels when said second top flap is in a closed position; and (b) said first and second bottom flaps are configured to conform in shape to said enclosure, said second bottom flap including first, second and third edges configured to contact and engage adjacent ones of said side panels when said second bottom flap is in a closed position.

4. The container of claim 2 wherein:

(a) said second top fold line is offset from said top plane by a first offset distance;

(b) said third and fourth top fold lines are offset from said top plane by a second offset distance smaller than said first offset distance;

(c) said second bottom fold line is offset from said bottom plane by said first offset distance; and (b) said third and fourth bottom fold lines are offset from said bottom plane by said second offset distance.

5. The container of claim 3 wherein said second top flap further includes first, second, third and fourth corner edges interposed between adjacent ones of said first, second and third edges, said corner edges configured to engage adjacent ones of said corner panels when said second top flap is in said closed position.

6. The container of claim 3 wherein said second bottom flap further includes first, second, third and fourth corner edges interposed between adjacent ones of said first, second and third edges, said corner edges configured to engage adjacent ones of said corner panels when said second bottom flap is in said closed position.

7. The container of claim 2 further comprising a glue panel joined to one of said corner panels and configured to bond to an adjacent side panel.

8. The container of claim 2 further comprising a perforation in one of said side panels, said perforation defining a spigot pop-out.

9. The container of claim 2 further comprising perforations in first and second top flaps, said perforations defining handle pop-outs.

10. A container, comprising:

(a) first and second opposing, parallel side panels;

(b) third and fourth opposing, parallel side panels, said third and fourth side panels perpendicular to said first and second side panels;

(c) first, second, third and fourth corner panels, each said corner panel interposed between adjacent ones of said side panels, said side panels and said corner panels configured to form an octagonal enclosure;

(d) first and second foldable top flaps respectively associated with said first and second side panels by first and second top creases, said first top crease coplanar with a top plane of said container, said first top flap lying in said top plane when said first top flap is folded;

(e) third and fourth foldable top flaps respectively associated with said third and fourth side panels by third and fourth top creases, said second, third and fourth top creases offset from said top plane, said second, third and fourth top flaps lying below said top plane when said second, third and fourth top flaps are folded;

(f) first and second foldable bottom flaps respectively associated with said first and second side panels by first and second bottom creases, said first bottom crease coplanar with a bottom plane of said container, said first bottom flap lying in said top plane when said first top bottom is folded;

(g) third and fourth foldable bottom flaps respectively associated with said third and fourth side panels by third and fourth creases, said second, third and fourth bottom creases offset from said bottom plane, said second, third and fourth bottom flaps lying above said bottom plane when said second, third and fourth bottom flaps are folded;

(h) said first, second third and fourth corner panels each having first, second, third and fourth top ends respectively, said first, second, third and fourth top ends extending above said second, third and fourth top creases to said top plane; and (i) said first, second third and fourth corner panels each having first, second, third and fourth bottom ends respectively, said first, second, third and fourth top ends extending below said second, third and fourth bottom creases to said bottom plane.

11. The container of claim 10 wherein:

(a) said first top flap is flush with said first, second, third and fourth corner panel top ends when said first top flap is folded to a closed position; and (b) said first bottom flap is flush with said first, second, third and fourth corner panel bottom ends when said first bottom flap is folded to a closed position.

12. The container of claim 11 wherein:

(a) said first and second top flaps are configured to conform in shape to said octagonal enclosure, said second top flap including first, second and third edges configured to contact and engage adjacent ones of said side panels when said second top flap is in a closed position; and (b) said first and second bottom flaps are configured to conform in shape to said enclosure, said second bottom flap including first, second and third edges configured to contact and engage adjacent ones of said side panels when said second bottom flap is in a closed position.

13. The container of claim 12 wherein:

(a) said second top fold crease is offset from said top plane by a first offset distance;

(b) said third and fourth top fold creases are offset from said top plane by a second offset distance smaller than said first offset distance;

(c) said second bottom fold crease is offset from said bottom plane by said first offset distance; and (d) said third and fourth bottom fold creases are offset from said bottom plane by said second offset distance.

14. The container of claim 12 wherein said second top flap further includes first, second, third and fourth corner edges interposed between adjacent ones of said first, second and third edges, said corner edges configured to engage adjacent ones of said corner panels when said second top flap is in said closed position.

15. The container of claim 12 wherein said second bottom flap further includes first, second, third and fourth corner edges interposed between adjacent ones of said first, second and third edges, said corner edges configured to engage adjacent ones of said corner panels when said second bottom flap is in said closed position.

16. The container of claim 10 further comprising a glue panel joined to one of said corner panels and configured to bond to an adjacent side panel.

17. The container of claim 10 further comprising a perforation in one of said side panels, said perforation defining a spigot pop-out.

18. The container of claim 10 further comprising perforations in first and second top flaps, said perforations defining handle pop-outs.

19. The container of claim 11 wherein:

(a) said third and fourth top flaps are foldable to positions beneath said first top flap when said first top flap is folded to a closed position;

(b) said second top flap is foldable to a position beneath said folded third and fourth top flaps;

(c) said third and fourth bottom flaps are foldable to positions above said first bottom flap when said first bottom flap is folded to closed position; and (d) said second bottom flap is foldable to a position above said folded third and fourth bottom flaps.

* * * * *